US005650265A

United States Patent [19]

Sniadoch et al.

[11] Patent Number: 5,650,265

[45] Date of Patent: Jul. 22, 1997

[54] SILVER HALIDE LIGHT-SENSITIVE ELEMENT

[75] Inventors: Henry Joseph Sniadoch, Canandaigua; Gary Norman Barber, Penfield, both of N.Y.

[73] Assignee: Eastman Kodak Company, Rochester, N.Y.

[21] Appl. No.: 577,757

[22] Filed: Dec. 22, 1995

[51] Int. Cl.[6] ..... G03C 1/85

[52] U.S. Cl. ..... 430/530; 430/524; 430/539; 430/605; 430/608; 430/612; 430/567; 430/527

[58] Field of Search ..... 430/527, 605, 430/608, 557, 607, 612, 615, 604, 539, 567, 524, 525, 530

[56] References Cited

U.S. PATENT DOCUMENTS

| | | | |
|---|---|---|---|
| 2,552,229 | 5/1951 | Stauffer et al. | 430/612 |
| 2,566,245 | 8/1951 | Trivelli et al. | 430/608 |
| 2,598,079 | 5/1952 | Stauffer et al. | 430/603 |
| 4,203,769 | 5/1980 | Guestaux | 430/63 |
| 4,242,429 | 12/1980 | Hara et al. | 430/551 |
| 4,254,195 | 3/1981 | Hara et al. | 430/551 |
| 4,273,854 | 6/1981 | Hara et al. | 430/551 |
| 4,275,103 | 6/1981 | Tsubusaki et al. | 430/63 |
| 4,301,223 | 11/1981 | Nakamura et al. | 430/551 |
| 4,394,441 | 7/1983 | Kawaguchi et al. | 430/524 |
| 4,416,963 | 11/1983 | Takimoto et al. | 430/69 |
| 4,418,141 | 11/1983 | Kawaguchi et al. | 430/530 |
| 4,431,764 | 2/1984 | Yoshizumi | 524/409 |
| 4,495,276 | 1/1985 | Takimoto et al. | 430/527 |
| 4,540,653 | 9/1985 | Nishijima et al. | 430/551 |
| 4,571,361 | 2/1986 | Kawaguchi et al. | 428/328 |
| 4,770,984 | 9/1988 | Ailliet et al. | 430/505 |
| 4,892,808 | 1/1990 | Harbison et al. | 430/517 |
| 4,999,276 | 3/1991 | Kuwabara et al. | 430/264 |
| 5,006,451 | 4/1991 | Anderson et al. | 430/527 |
| 5,122,445 | 6/1992 | Ishigaki | 430/523 |
| 5,221,598 | 6/1993 | Anderson et al. | 430/527 |
| 5,368,995 | 11/1994 | Christian et al. | 430/530 |
| 5,455,153 | 10/1995 | Gardner | 430/527 |

FOREIGN PATENT DOCUMENTS

| | | | |
|---|---|---|---|
| 572022 | 12/1993 | European Pat. Off. . | |
| 578225 | 1/1994 | European Pat. Off. . | |
| 597312 | 5/1994 | European Pat. Off. . | |
| 1157077 | 5/1964 | Germany . | |
| 148818 | 5/1994 | Japan . | |
| 6138580 | 5/1994 | Japan | 430/527 |
| 1656491 | 6/1991 | U.S.S.R. . | |

*Primary Examiner*—Lee C. Wright
*Attorney, Agent, or Firm*—Andrew J. Anderson

[57] ABSTRACT

Palladium compounds are incorporated into a relatively low speed photographic print element. One embodiment of the invention comprises a silver halide light sensitive photographic print element comprising a support bearing at least one silver halide emulsion image forming layer, an antistatic layer containing vanadium pentoxide, and a palladium compound. In a preferred embodiment, the silver halide light sensitive photographic print element of the invention comprises a support bearing on one side thereof at least one blue-sensitive silver halide emulsion yellow-image forming layer, at least one red-sensitive silver halide emulsion cyan-image forming layer, and at least one green-sensitive silver halide emulsion magenta-image forming layer; an antistatic layer containing vanadium pentoxide; and a palladium compound. The photographic print elements of the invention improve unexpected poor keeping performance under moderate humidity conditions demonstrated by print elements which comprise vanadium pentoxide containing antistatic layers. The elements of the invention additionally provide excellent protection against static charge and excellent transparency due to the use of vanadium pentoxide, which properties are not significantly dependent on ambient humidity.

17 Claims, No Drawings

SILVER HALIDE LIGHT-SENSITIVE ELEMENT

TECHNICAL FIELD

This invention relates generally to the field of silver halide light sensitive elements, and in particular to such photographic print elements having a vanadium pentoxide containing antistatic layer. In a particular aspect it relates to motion picture print films.

BACKGROUND OF THE INVENTION

It is known that in silver halide photographic elements, silver ions can be reduced to form metallic deposits of silver. When these deposits are unintended, such as when a camera containing the element leaks light thus exposing the element, or when physical pressure is applied to the element's emulsion layers by, for example, a component of a camera, then they are termed fog. Fog can be formed locally or generally. Described above are two ways in which to form local fog. General fog, which occurs more or less uniformly across an entire element or emulsion layer, is typically formed in response to the ambient conditions in which the element is stored. For example, many high speed photographic elements, such as camera negative films, are susceptible to general fog formation and sensitivity loss when they are stored for an extended period of time in conditions of high temperature and humidity. General fog may also be formed by action of reducing agents contained in the photographic elements, or which are generated during storage thereof.

It has been known that certain palladium salts, when incorporated into a high speed photographic emulsion, stabilize the emulsion and impart to it an increased resistance to fog formation and sensitivity loss. Palladium glycine complexes, in particular, have been known to control general fog formation and sensitivity loss in high speed photographic elements stored under tropical conditions. Accordingly, such palladium complexes are utilized in many photographic silver halide camera negative materials currently commercialized. Palladium compounds have also been proposed for use as scavengers for cyanide which may be generated from components incorporated in a photographic element or its packaging. Uses of palladium complexes are described, e.g., in U.S. Pat. Nos. 2,552,229, 2,566,245, 2,598,079 and 4,892,808; European Patent Applications 0 572 022; 0 578 225; and 0 597 312; Soviet Union Patent 1,656,491; and German Patent 1,157,077. In U.S. Pat. No. 2,552,229, e.g., the sensitivity, gamma, and fog-inhibiting effects of a series of palladium complexes on high speed silver bromoiodide emulsions under varying temperature and humidity storage conditions are explored. In EP 0 572 022, palladium compounds are proposed as cyanide scavengers for hydrogen cyanide gas generated in photographic elements comprising silver halide emulsion layers containing gold and chalcogen sensitized silver halide grains and a thiocyanate salt. EP 0 597 312 describes the use of palladium compounds to protect photographic elements from fog generated by chlorinated s-triazine hardeners and photographically useful chemical compounds containing cyano groups. EP 0 439 069 describes restricting the amount of cyanide generating compounds used in a photographic element in order to control fog generation.

The photographic industry has also long recognized the need to provide photographic films and papers with antistatic protection to prevent the accumulation of static charges during manufacture and use. Such protection is advantageous in photographic elements as static charges can cause irregular fog patterns in photographic silver halide imaging emulsions. Static charges are also undesirable because they attract dirt to the photographic element and this can cause repellency spots, desensitization, fog and physical defects. To prevent the problems arising from an accumulation of static charges, it is a conventional practice to provide an antistatic layer (i.e., a conductive layer) in a photographic element.

Photographic elements further typically comprise some form of antihalation protection. Halation has been a persistent problem with photographic films comprising one or more photosensitive silver halide emulsion layers coated on a transparent support. The emulsion layer diffusely transmits light, which then reflects back into the emulsion layer from the support surface. The silver halide emulsion is thereby reexposed at locations different from the original light path through the emulsion, resulting in "halos" on the film surrounding images of bright objects.

One method proposed for antistatic and antihalation protection in photographic films comprises providing a dyed or pigmented layer behind a clear support as an antihalation backing layer, wherein the backing layer is designed to be removed during processing of the film. Typical examples of such antihalation backing layers comprise a light absorbing dye or pigment (such as carbon black) dispersed in an alkali-soluble polymeric binder (such as cellulose acetate hexahydrophthalate) that renders the layer removable by an alkaline photographic processing solution. Such carbon containing "rem-jet" backing layers have been commonly used for antihalation protection in motion picture films. The carbon particles additionally provide antistatic protection prior to being removed. While such rem-jet backing layers provide effective antihalation and antistatic protection for photographic films prior to processing, their use requires special additional processing steps for their subsequent removal, and incomplete removal of the carbon particles can cause image defects in the resulting print film. Additionally, it is often desirable to provide "process surviving" antistatic protection for photographic elements in order to prevent static build-up even after imagewise exposure and processing, especially for motion picture films which are subject to rapid transport through projection apparatus where static charges can attract dust particles which may detrimentally impact a projected image.

Accordingly, alternatives for carbon-containing, process-removable, antihalation/antistatic backing layers for photographic materials are desirable. One such alternative is to use an antihalation layer or layers containing filter dye or silver metal coated between the support and the emulsion layers, wherein the filter dye or silver is solubilized and removed and/or decolorized during processing of the film, and a separate process-surviving antistatic backing layer. Process-surviving antistatic layers typically include, e.g., ionic polymers, electronic conducting non-ionic polymers, and metal halides or metal oxides in polymeric binders. Conductive fine particles of crystalline metal oxides dispersed with a polymeric binder have been found to be especially desirable for preparing optically transparent, humidity insensitive, antistatic layers for various imaging applications.

Many different metal oxides, such as AnO, $TiO_2$, $ZrO_2$, $Al_2O_3$, $SiO_2$, MgO, BaO, $MoO_3$, and $V_2O_5$, are disclosed as useful as antistatic agents in photographic elements or as conductive agents in electrostatographic elements in such patents as U.S. Pat. Nos. 4,203,769, 4,275,103; 4,394,441; 4,416,963; 4,418,141; 4,431,764; 4,495,276; 4,571,361;

4,999,276; and 5,122,445. The use of metal oxide materials is further advantageous, as their antistatic properties allow the use of a protective overcoat layer such as a layer of cellulosic material to provide abrasion protection and/or enhance frictional characteristics while still providing acceptable antistatic performance. Antistatic layers which contain vanadium pentoxide have been found to provide excellent protection against static and are highly advantageous in that they have excellent transparency and their performance is not significantly affected by changes in humidity.

Photographic print elements generally have been found to be far less susceptible to fog generation upon storage under high humidity conditions than camera negative films. Relatively small grain, high chloride emulsions (e.g., emulsions having average grain size equivalent circular diameters of less than about 1 micron and halide contents of greater than 50 mole % chloride) are typically used in photographic print films and papers in order to optimize print image quality and enable rapid processing. Such emulsions typically result in relatively low speed photographic elements in comparison to camera negative films. Low speed is compensated for by the use of relatively high intensity print lamps or lasers for exposing such print elements. For comparison purposes, it is noted that print films and papers, such as motion picture color print films, e.g., when rated using the same international standards criteria used for rating camera negative films, would typically have an ISO speed rating of less than 10, which is several stops slower than the slowest camera negative films in current use.

PROBLEMS TO BE SOLVED

It has been unexpectedly found by Applicants that relatively low speed silver halide photographic print elements surprisingly exhibit general fog increases under even moderate humidity storage conditions when vanadium pentoxide particles are used in an antistatic layer. This finding was surprising to Applicants and was not suggested by the prior art. It would be desirable to provide photographic print elements, such as photographic elements which would have an ISO speed rating of less than 10, having vanadium pentoxide containing antistatic layers with increased fog resistance.

SUMMARY OF THE INVENTION

We have found that palladium compounds can be incorporated into a relatively low speed photographic print element to prevent unexpected fog increases in such print elements containing vanadium pentoxide containing antistatic layers. One embodiment of the invention comprises a silver halide light sensitive photographic print element comprising a support bearing at least one silver halide emulsion image forming layer, an antistatic layer containing vanadium pentoxide, and a palladium compound. In a preferred embodiment, the silver halide light sensitive photographic print element of the invention comprises a support bearing on one side thereof at least one blue-sensitive silver halide emulsion yellow-image forming layer, at least one red-sensitive silver halide emulsion cyan-image forming layer, and at least one green-sensitive silver halide emulsion magenta-image forming layer; an antistatic layer containing vanadium pentoxide; and a palladium compound.

ADVANTAGES

The photographic print elements of the invention improve unexpected poor keeping performance demonstrated by print elements which comprise vanadium pentoxide containing antistatic layers. The elements of the invention additionally provide excellent protection against static charge and excellent transparency due to the use of vanadium pentoxide, which properties are not significantly dependent on ambient humidity.

DETAILED DESCRIPTION

While photographic elements of the invention can be black-and-white or single color elements, 5 preferred elements are multicolor elements. Multicolor elements typically contain image dye-forming units sensitive to each of the three primary regions of the visible spectrum, i.e. blue (about 400 to 500 nm), green (about 500 to 600 nm), and red (about 600 to 760 nm) sensitive image dye-forming units. Each unit can comprise a single emulsion layer or multiple emulsion layers sensitive to a given region of the spectrum. The layers of the element, including the layers of the image-forming units, can be arranged in various orders as known in the art. The invention is particularly applicable to photographic print elements designed for exposure though a negative film and projection display, such as motion picture print and intermediate films.

In accordance with photographic elements of the invention, an antistatic layer is present which comprises vanadium pentoxide, preferably dispersed with a polymeric binder. The preparation of an antistatic layer from a composition of vanadium pentoxide colloidal gel is described in, e.g., U.S. Pat. Nos. 4,203,769; 5,006,451; 5,221,598; and 5,368,995, the disclosures of which are hereby incorporated by reference. Antistatic layers containing vanadium pentoxide provide excellent protection against static charge and have the advantage of excellent transparency and their performance is not significantly dependent on ambient humidity. The excellent performance of these antistatic layers results from the particular morphology of this material. The colloidal vanadium pentoxide gel consists of entangled, high aspect ratio, flat ribbons about 50–100 angstroms wide, about 10 angstroms thick and about 1000–10,000 angstroms long. Low surface resistivities can be obtained with very low vanadium pentoxide coverage as a result of this high aspect ratio morphology.

In a preferred embodiment of the invention, the antistatic layer is coated on the opposite side of the element support relative to the element's light sensitive image forming layers. The antistatic layer is preferably process surviving, and may include a protective overcoat layer to provide abrasion resistance and/or enhanced frictional characteristics. Typically the dried coating weight of the vanadium pentoxide antistatic material is about 0.5 to 30 mg/m$^2$. The weight ratio of polymer binder to vanadium pentoxide can range from about 1:5 to 500:1, but is preferably from 1:1 to 10:1. Typically, the antistatic layer is coated at a dry coverage of from 1 to 400 mg/m$^2$ based on total dry weight. The electrical resistivity of the antistatic layer is preferably from out 7 to 11 log Ω/square, and most preferably less than 9 log Ω/square.

Preferred binders which may be included in the antistatic layer of the photographic elements of the invention include vinylidene chloride-containing polymer latexes and polyesterionomer dispersions, which can improve the integrity of the antistatic layer and the adhesion of the layer to the support. Polyesterionomers refers to polyesters that contain at least one ionic moiety. Such ionic moieties function to make the polymer water dispersable. These polymers are prepared by reacting one or more dicarboxylic acids or their functional equivalents such as anhydrides, diesters, or diacid halides with one or more diols in melt-phase polycondensation reactions well known in the art as shown in U.S. Pat. Nos. 3,018,272; 3,929,489; 4,307,174; and 4,419,437. Examples of this class of polymers include, for example, Eastman AQ™ polyesterionomers manufactured by Eastman Chemical Company.

The palladium compound included in the photographic elements of the invention may be incorporated at any location of the element, but is preferably present in a silver halide emulsion layer or a hydrophilic layer adjacent thereto. The palladium compound can be a salt of palladium, a complex salt of palladium, or a neutral complex of palladium. Examples of salts include potassium tetrachloropalladate(II), ammonium tetrachloropalladate(II), and potassium hexachloropalladate(IV). More preferable are complexes of amines with palladium, such as bis(1,2-ethane diamine-N,N')palladium(II) dichloride and complexes of palladium with glycine. The complexes of amines with palladium may either be prepared, isolated, and then added to a layer coating composition, or more preferably created in-situ by treating a solution of potassium tetrachloropalladate (II) with the complexing agent, followed by addition to a coating solution. The palladium compound is preferably incorporated into a photographic element layer at levels of 0.1 to 100 mg/m$^2$ of palladium, more preferably 0.1 to 20 mg/m$^2$ of palladium.

In accordance with the particularly preferred embodiment of the present invention, the palladium compound is incorporated into a gelatin containing layer of a photographic element, and the palladium compound is of the following structure:

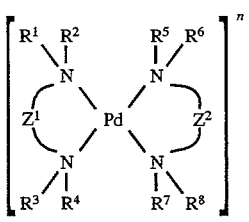

(I)

wherein $R^1$, $R^2$, $R^3$, $R^4$, $R^5$, $R^6$, $R^7$, and $R^8$ are independently selected from hydrogen, alkyl, alkenyl, aryl or alkaryl groups, the alkyl, alkenyl, aryl, or alkaryl groups optionally being substituted with a hydroxy, sulfonate, amino or ammonium group; and wherein any two of $R^1$, $R^2$, $R^3$, $R^4$, $R^5$, $R^6$, $R^7$, and $R^8$can be bonded to form a ring; $Z^1$ and $Z^2$ independently represent the number of carbon atoms necessary to form a 5- or 6-membered ring, inclusive of palladium, wherein the carbon atoms may be substituted with hydrogen, sulfonate, alkyl, alkenyl, aryl or alkaryl groups, the alkyl, alkenyl, aryl, or alkaryl groups optionally being substituted with a hydroxy, halogen, sulfonate, amino or ammonium group; and n is −2 to +4 (optimally +2); and wherein the ratio of palladium complex to gelatin is from about $2.5\times10^{-2}$ to about $1.0\times10^{-4}$ mol palladium complex to 1000 grams of gelatin. Aqueous coating compositions of such layers are not prone to viscosity rises and concurrent slug formation that typically accompanies the use of other palladium complexes in gelatin containing solutions, providing a means by which to avoid coating defects as set forth in copending, commonly assigned U.S. patent application Ser. No. 08/357,474, filed Dec. 16, 1994, the disclosure of which is hereby incorporated by reference.

In the preferred palladium complex described above, the substituents represented by $R^1$, $R^2$, $R^3$, $R^4$, $R^5$, $R^6$, $R^7$, and $R^8$ can be bonded to one another in pairs to form one or more cyclic organic rings, preferably one or more 5- or 6-membered cyclic organic rings, or organometallic rings including the palladium atom. In this manner, it is contemplated $R^1$ and $R^3$ may be alkyl chains that are bonded to each other to form a cyclic organic ring, for instance a piperizine ring. Similarly, $R^1$ and $R^2$ may be alkyl chains that are bonded to each other to form an organic ring such as pyrrolidine or pyridine. Other combinations forming rings are also contemplated. For instance, $R^2$ and $R^5$ may be alkyl chains bonded together as in N,N'-bis(2-aminoethyl)-1,2-ethanediamine-N,N'N",N'")-palladium (2+)ion.

Suitable exemplary substituents satisfying $R^1$, $R^2$, $R^3$, $R^4$, $R^5$, $R^6$, $R^7$, and $R^8$ are the alkyl groups: methyl, ethyl, propyl, butyl, pentyl, hexyl, octyl, ethylhexyl, decyl, dodecyl, hexadecyl, octadecyl, isopropyl, and t-butyl; the alkenyl groups: propenyl, butenyl, pentenyl, hexenyl, and cyclohexenyl; the aryl groups: phenyl, tolyl, naphthyl, and pyridyl; and the alkaryl groups: benzyl and 2-phenylethyl. All such groups are capable of being substituted as described.

Suitable substituents on $Z^1$ and $Z^2$ are those described above with reference to $R^1$, $R^2$, $R^3$, $R^4$, $R^5$, $R^6$, $R^7$, and $R^8$. In particular, it is preferred that $Z^1$ and $Z^2$ independently represent the number of carbon atoms necessary to form an unsubstituted or alkyl substituted 5-or 6- membered ring.

In the present invention, the palladium complex preferably comprises palladium(II) as the palladium ion, and has a neutral, negative or positive charge. When it is an anion or cation, the palladium complex is typically incorporated into a coating composition in association with an anion(s) or cation(s) of sufficient charge to balance the charge of the complex. Halide ions, preferably chloride, or nitrate, sulfate, or acetate ions are normally utilized to balance the charge of the cationic palladium complex, although it is specifically contemplated that any ion(s) of sufficient balancing charge would be practical.

It is believed that in accordance with the invention, certain palladium complexes comprising palladium (IV) as the palladium ion will be converted to palladium (II) complexes when incorporated into a gelatin containing solution. This conversion is believed to be due to reduction of the palladium complex by components of the gelatin containing solution.

A preferred palladium complex suitable for use in the present invention has the structure:

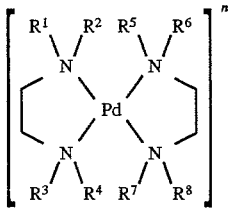

(II)

wherein $R^2$, $R^3$, $R^6$, and $R^7$ are hydrogen, and $R^1$, $R^4$, $R^5$, $R^8$, and n are as described as above. More preferably, $R^2$, $R^3$, $R^6$, and $R^7$ are hydrogen, and $R^1$, $R^4$, $R^5$, $R^8$ are selected from hydrogen or a substituted or unsubstituted lower alkyl having from 1 to 5 carbon atoms.

Specifically preferred palladium complexes, described in association with an appropriate anion(s), are

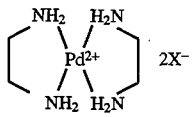

P-1: X = Cl
P-2: X = Acetate

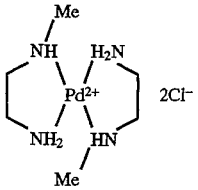

P-3

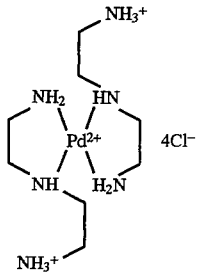

P-4

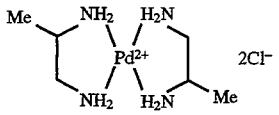

P-5

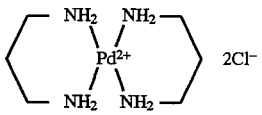

P-6

Additional compounds comtemplated to be used in the present invention include: bis(N,N-dimethyl-1,2-ethanediamine-N,N')-palladium (2+)dichloride (P-7), bis(N,N'-dimethyl-1,2-ethanediamine-N,N')-palladium (2+) dichloride (P-8), bis(N,N,N'-trimethyl-1,2-ethanediamine-N,N')-palladium (2+)dichloride (P-9), bis(N,N,N',N'-tetramethyl-1,2-ethanediamine-N,N,)-palladium (2+) dichloride (P-10), bis-N,N'-(2-ammoniumethyl)-1,2-ethanediamine-N,N')-palladium (2+) tetrachloride (P-11), (N, N'-bis (2-aminoethyl)-1,2-ethanediamine-N,N'N"N'")-palladium(2+) dichloride (P-12), and dibromo-bis(1,2-ethanediamine-N,N')-palladium (IV)(2+)dibromide (P-13).

It is believed that some of the compounds described above are in equilibrium in coating compositions. An example is P-4, bis(N-(2-ammoniumethyl)-1,2-ethanediamine-N,N')-palladium (2+) tetrachloride, which is believed to be in equilibrium with tri-coordinated diethylenetriamine complexes.

It is contemplated that with regard to the compounds described above, the particular counterion(s) specified is irrelevant and may be replaced by any suitable counterion (s). It is also contemplated that the isomers of the compounds described above are equally as suitable for the present invention.

In the most preferred embodiment of the invention, the palladium complex is a bis(1,2-ethanediamine-N,N') palladium(II) cation.

Palladium complexes are commercially available or can be readily synthesized by known methods from commercially available reactants. A specific synthesis of the preferred bis(1,2-ethanediamine-N,N') palladium(2+) dichloride consists of reacting dipotassium or diammonium tetrachloropalladate (1 mole) with 1,2-ethanediamine dihydrochloride (≧2 moles) and neutralizing rapidly to a pH of 7 with sodium hydroxide. N. S. Kurakow and N. J. Gwosdaren Z. Anorg. Chem 22, 384 (1899) is incorporated herein by reference as describing an alternative synthesis of this complex.

The invention is particularly useful with color photographic print elements. In color photographic element printing, there are usually three records to record in the image area frame region of a print film, i.e., red, green and blue. The original record to be reproduced is preferably an image composed of sub-records having radiation patterns in different regions of the spectrum. Typically it will be a multicolor record composed of sub-records formed from cyan, magenta and yellow dyes. The principles by which such materials form a color image are described in James, The Theory of the Photographic Process, Chapter 12, Principles and Chemistry of Color Photography, pp 335–372, 1977, Macmillan Publishing Co. New York, and suitable materials useful to form original records are described in *Research Disclosure,* December, 1987, Item 17643, published by Industrial Opportunities Ltd., Homewell Havant, Hampshire, P09 1EF, United Kingdom, and *Research Disclosure,* September 1994, Item 36544, published by Kenneth Mason Publications, Ltd., Emsworth, Hampshire P010 7DQ, England. Materials in which such images are formed can be exposed to an original scene in a camera, or can be duplicates formed from such camera origination materials, e.g., records formed in color negative intermediate films such as those identified by the tradenames Eastman Color Intermediate Films 2244, 5244 and 7244. Alternatively, the original record may be in the form of electronic image data, which may be used to control a printer apparatus, such as a laser printer, for selective imagewise exposure of a print film in accordance with the invention.

The photographic element of the invention preferably comprise a support bearing light sensitive image dye forming layers sensitized to the blue (approx. 380–500 nm), green (approx. 500–600 nm), and red (approx. 600–760 nm) regions of the electromagnetic spectrum. In accordance with a preferred embodiment of the invention, the element comprises cyan, magenta and yellow dye forming silver halide emulsion layers sensitized to the red, green and blue regions of the spectrum. Such materials are described in the Research Disclosure publications cited above. It is within the scope of this invention for the light sensitive material to also be sensitive to one or more regions of the electromagnetic spectrum outside the visible, such as the infrared region of the spectrum. In most color photographic systems, color-forming couplers are incorporated in the light-sensitive photographic emulsion layers so that during development, they are available in the emulsion layer to react with the color developing agent that is oxidized by silver halide image development. Diffusible couplers are used in color developer solutions. Non-diffusing couplers are incorporated in photographic emulsion layers. When the dye image formed is to be used in situ, couplers are selected which form non-diffusing dyes. Color photographic systems can also be used to produce black-and-white images from non-diffusing couplers as described by Edwards et al. in International Publication No. WO 93/012465.

In the following discussion of suitable materials for use in the emulsions and elements that can be used in conjunction with the invention, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

Suitable silver halide emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing conditions can be found in Sections XI–XX.

It is also contemplated that the materials and processes described in an article titled "Typical and Preferred Color Paper, Color Negative, and Color Reversal Photographic Elements and Processing," published in *Research Disclosure*, February 1995, Item 37038 also may be advantageously used with elements of the invention.

Photographic light-sensitive print elements of the invention may utilize silver halide emulsion image forming layers wherein chloride, bromide and/or iodide are present alone or as mixtures or combinations of at least two halides. The combinations significantly influence the performance characteristics of the silver halide emulsion. Print elements are typically distinguished from camera negative elements by the use of high chloride (e.g., greater than 50 mole% chloride) silver halide emulsions containing no or only a minor amount of bromide (typically 10 to 40 mole %), which are also typically substantially free of iodide. As explained in Atwell, U.S. Pat. No. 4,269,927, silver halide with a high chloride content possesses a number of highly advantageous characteristics. For example, high chloride silver halides are more soluble than high bromide silver halide, thereby permitting development to be achieved in shorter times. Furthermore, the release of chloride into the developing solution has less restraining action on development compared to bromide and iodide and this allows developing solutions to be utilized in a manner that reduces the amount of waste developing solution. Since print films are intended to be exposed by a controlled light source, the imaging speed gain which would be associated with high bromide emulsions and/or iodide incorporation offers little benefit for such print films.

Photographic print elements are also distinguished from camera negative elements in that print elements typically comprise only fine silver halide emulsions comprising grains having an average equivalent circular diameter (ECD) of less than about 1 micron, where the ECD of a grain is the diameter of a circle having the area equal to the projected area of a grain. The ECDs of silver halide emulsion grains are usually less than 0.60 micron in red and green sensitized layers and less than 0.90 micron in blue sensitized layers of a color photographic print element. Such fine grain emulsions used in print elements generally have an aspect ratio of less than 1.3, where the aspect ratio is the ratio of a grain's ECD to its thickness. Such grains may take any regular shapes, such as cubic, octahedral or cubo-octahedral (i.e., tetradecahedral) grains, or the grains can take other shapes attributable to ripening, twinning, screw dislocations, etc. Typically, print element emulsions grains are bounded primarily by {100} crystal faces, since {100} grain faces are exceptionally stable. Specific examples of high chloride emulsions used for preparing photographic prints are provided in U.S. Pat. Nos. 4,865,962; 5,252,454; and 5,252,456, the disclosures of which are here incorporated by reference.

Couplers that may be used in the elements of the invention can be defined as being 4-equivalent or 2-equivalent depending on the the number of atoms of $Ag^+$ required to form one molecule of dye. A 4-equivalent coupler can generally be converted into a 2-equivalent coupler by replacing a hydrogen at the coupling site with a different coupling-off group. Coupling-off groups are well known in the art. Such groups can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, alkylthio (such as mercaptopropionic acid), arylthio, phosphonyloxy and arylazo. These coupling-off groups are described in the art, for example, in U.S. Pat. Nos. 2,455,169; 3,227,551; 3,432,521; 3,476,563; 3,617,291; 3,880,661; 4,052,212 and 4,134,766; and in U.K. Patents and published Application Nos. 1,466,728; 1,531,927; 1,533,039; 2,006,755A and 2,017,704A, the disclosures of which are incorporated herein by reference.

Image dye-forming couplers may be included in elements of the invention such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948.

Typical cyan couplers are represented by the following formulas:

CYAN-1

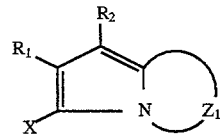

CYAN-2

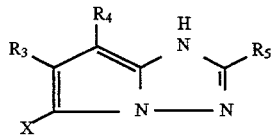

CYAN-3

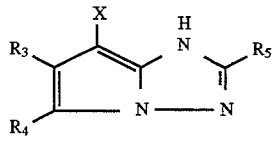

-continued

CYAN-4

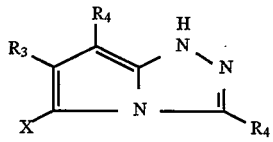

CYAN-5

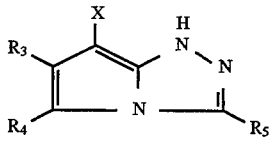

CYAN-6

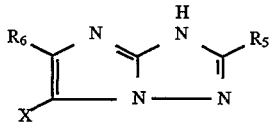

wherein $R_1$ and $R_5$ each represent a hydrogen or a substituent; $R_2$ represents a substituent; $R_3$ and $R_4$ each represent an electron attractive group having a Hammett's substituent constant spara of 0.2 or more and the sum of the spara values of $R_3$ and $R_4$ is 0.65 or more; $R_6$ represents an electron attractive group having a Hammett's substituent constant spara of 0.35 or more; X represents a hydrogen or a coupling-off group; $Z_1$represents nonmetallic atoms necessary for forming a nitrogen-containing, six-membered, heterocyclic ring which has at least one dissociative group. A dissociative group has an acidic proton, e.g. —NH—, —CH(R)—, etc., that preferably has a pKa value of from 3 to 12 in water. The values for Hammett's substituent constants can be found or measured as is described in the literature. For example, see C. Hansch and A. J. Leo, J. Med. Chem., 16, 1207 (1973); J. Med. Chem., 20, 304 (1977); and J. A. Dean, Lange's Handbook of Chemistry, 12th Ed. (1979) (McGraw-Hill).

More preferable are cyan couplers of the following formulas:

CYAN-7

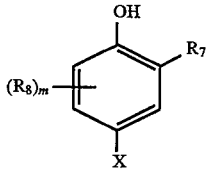

CYAN-8

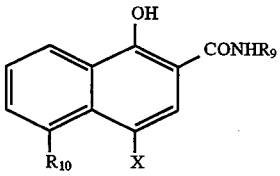

wherein $R_7$ represents a substituent (preferably a carbamoyl, ureido, or carbonamido group); $R_8$ represents a substituent (preferably individually selected from halogen, alkyl, and carbonamido groups); $R_9$ represents a ballast substituent; $R_{10}$ represents a hydrogen or a substituent (preferably a carbonamido or sulphonamido group); X represents a hydrogen or a coupling-off group; and m is from 1–3. Couplers of the structure CYAN-7 are most preferable for use in elements of the invention.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent Applications 176,804; 177,765; U.S Pat. Nos. 4,659,652; 5,066,575; and 5,250,400.

Typical pyrazoloazole and pyrazolone couplers are represented by the following formulas:

MAGENTA-1

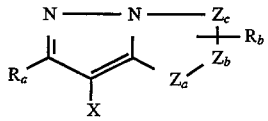

MAGENTA-2

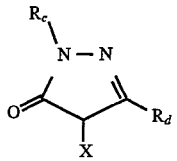

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C, or —NH—, provided that one of either the $Z_a$–$Z_b$ bond or the $Z_b$–$Z_c$ bond is a double bond and the other is a single bond, and when the $Z_b$–Zc bond is a carbon-carbon double bond, it may form part of an aromatic ring, and at least one of $Z_a$, $Z_b$, and $Z_c$ represents a methine group connected to the group $R_b$.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

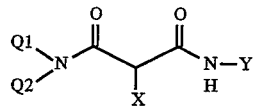

YELLOW-2

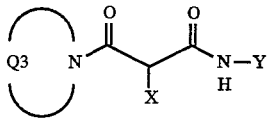

-continued

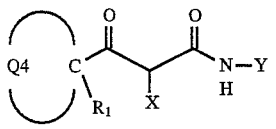

YELLOW-3

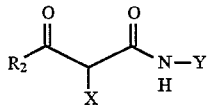

YELLOW-4 wherein $R_1$, $R_2$, $Q_1$ and $Q_2$ each represent a substituent; X is hydrogen or a coupling-off group; Y represents an aryl group or a heterocyclic group; $Q_3$ represents an organic residue required to form a nitrogen-containing heterocyclic group together with the illustrated nitrogen atom; and $Q_4$ represents nonmetallic atoms necessary to form a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represent an alkyl group, an aryl group, or a heterocyclic group, and $R_2$ represents an aryl or tertiary alkyl group. Preferred yellow couplers for use in elements of the invention are represented by YELLOW-4, wherein $R_2$ represents a tertiary alkyl group, Y represents an aryl group, and X represents an aryloxy or N-heterocyclic coupling-off group.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to a polymeric backbone.

Typical examples of photographic substituents include alkyl, aryl, anilino, carbonamido, sulfonamido, alkylthio, arylthio, alkenyl, cycloalkyl, and further to these exemplified are halogen, cycloalkenyl, alkynyl, heterocyclyl, sulfonyl, sulfinyl, phosphonyl, acyl, carbamoyl, sulfamoyl, cyano, alkoxy, aryloxy, heterocyclyloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclylthio, spiro compound residues and bridged hydrocarbon compound residues. Usually the substituent will have less than 30 carbon atoms and typically less than 20 carbon atoms. It is understood throughout this specification that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form substituted with any other photographically useful substituents.

It may be useful to use a combination of couplers any of which may contain known ballasts or coupling-off groups such as those described in U.S. Pat. Nos. 4,301,235; 4,853,319 and 4,351,897.

If desired, the photographic elements of the invention can be used in conjunction with an applied magnetic layer as described in *Research Disclosure*, November 1992, Item 34390 published by Kenneth Mason Publications, Ltd., Dudley House, 12 North Street, Emsworth, Hampshire P010 7DQ, ENGLAND.

To provide protection of the antistatic layer in the elements of the invention, a protective overcoat may be applied thereon. The protective layer can chemically isolate the antistatic layer and also serve to provide scratch and abrasion resistance. The protective overcoat layers may be, e.g., cellulose esters, cellulose nitrate, polyesters, acrylic and methacrylic copolymers and homopolymers, polycarbonates, pollvinyl formal polymethyl methacrylate, polysilicic acid, polyvinyl alcohol, and polyurethanes. Such layers may be aqueous coated or organic solvent coated as appropriate. The antistatic layer may also be overcoated with a barrier layer comprising a latex polymer having hydrophilic functionality as disclosed in U.S. Pat. No. 5,006,451 if desired. Such barrier layers provides excellent adhesion between vanadium pentoxide antistatic layers and overlying layers. A protective topcoat may also be preferably used as described in copending, commonly assigned U.S. Ser. No. 08/576,796, filed Dec. 21, 1995 corresponding to Provisionally filed U.S. Ser. No. 60/006179 (Kodak Docket No. 73068APL), filed Nov. 2, 1995, the disclosure of which is incorporated by reference herein, which comprises a polyurethane binder and a lubricant, where the polyurethane binder has a tensile elongation to break of at least 50% and a Young's modulus measured at 2% elongation of at least 50,000 lb/in$^2$.

The chemical resistance of the antistatic layer or an overcoat can be improved by incorporating a polymer cross-linking agent into the antistatic layer or those overcoats that have functionally cross-linkable groups. Cross-linking agents such as aziridines, carbodiimide, epoxys, and the like are suitable for this purpose.

A suitable lubricant may also be included in the antistatic layer or protective overcoat in order to provide desired friction performance to assure good transport characteristics during manufacturing and handling of the elements of the invention. Many lubricating agents can be used including higher alcohol esters of fatty acids, higher fatty acid calcium salts, metal stearates, silicone compounds, paraffins and the like. Suitable lubricants include silicone oil, silicones having polar groups, fatty acid-modified silicones, fluorine-containing silicones, fluorine-containing alcohols, fluorine-containing esters, polyolefins, polyglycols, alkyl phosphates and alkali metal salts thereof, alkyl sulfates and alkali metal salts thereof, polyphenyl ethers, fluorine-containing alkyl sulfates and alkali metal salts thereof, monobasic fatty acids having 10 to 24 carbon atoms (which may contain unsaturated bonds or may be branched) and metal salts thereof (such as Li, Na, K and Cu), monovalent, divalent, trivalent, tetravalent, pentavalent and hexavalent alcohols having 12 to 22 carbon atoms (which may contain unsaturated bonds or may be branched), alkoxy alcohols having 12 to 22 carbon atoms, mono-, di- and tri-esters of monobasic fatty acids having 10 to 24 carbon atoms (which may contain unsaturated bonds or may be branched) and one of monovalent, divalent, trivalent, tetravalent, pentavalent and hexavalent alcohols having 2 to 12 carbon atoms (which may contain unsaturated bonds or may be branched), fatty acid esters of monoalkyl ethers of alkylene oxide polymers, fatty acid amides having 8 to 22 carbon atoms and aliphatic amines having 8 to 22 carbon atoms. Specific examples of these compounds (i.e., alcohols, acids or esters) include lauric acid, myristic acid, palmitic acid, stearic acid, behenic acid, butyl stearate, oleic acid, linolic acid, linolenic acid, elaidic acid, octyl stearate, amyl stearate, isooctyl stearate, octyl myristate, butoxyethyl stearate, anhydrosorbitan monostearate, anhydrosorbitan distearate, anhydrosorbitan tristearate, pentaerythrityl tetrastearate, oleyl alcohol and lauryl alcohol. Aqueous dispersed lubricants are preferred as they may be directly incorporated into an aqueous antistatic or overcoat layer, thus avoiding the need for a separately applied lubricant layer. The aqueous dispersed lubricants of carnauba wax and stearates are preferred for their effectiveness in controlling friction at low lubricant levels and their excellent compatibility with aqueous overcoat polymer solutions.

Matting agents may also be included in the antistatic layer or overcoat thereon in order to improve transport properties of the elements of the invention on manufacturing, printing, processing, and projecting equipment. Such matting agents can also help prevent sticking between the front and back sides of the elements in a tightly wound roll. Matting agents may be, e.g., silica, calcium carbonate, other mineral oxides, glass spheres, ground polymers and high melting point waxes, and polymeric matte beads.

The antistatic layer may also contain a coating aid to improve coatability, including anionic or nonionic coating aids such as para-isononylphenoxyglycidol ethers, octylphenoxy polyethoxy ethanol, sodium salt of alkylaryl polyether sulfonate, and dioctyl esters of sodium sulfosuccinic acid. Such coating aids are typically used at from 0.01 to 0.30 weight percent based on the total coating solution weight.

Preferred supports for elements in accordance with the invention comprise transparent polymeric films, such as cellulose nitrate and cellulose esters (such as cellulose triacetate and diacetate), polycarbonate, and polyesters of dibasic aromatic carboxylic acids with divalent alcohols such as poly(ethylene terephthalate). In addition to the light sensitive image forming layers and the antistatic and overcoat layers described above, the photographic elements of the invention may include further features and layers as are known in the art. Polyester supports, e.g., typically employ undercoat or primer layers to improve adhesion of other layers thereto. Such undercoat layers are well known in the art and comprise, e.g., a vinylidene chloride/methyl acrylate/itaconic acid terpolymer or vinyldene chloride/acrylonitrile/acrylic acid terpolymer as described in U.S. Pat. Nos. 2,627,088; 2,698,235; 2,698,240; 2,943,937; 3,143,421; 3,201,249; 3,271,178; 3,501,301.

Photographic elements of the invention preferably comprise an antihalation layer comprising process removable filter dyes or silver. The antihalation layer may be located between the light sensitive layers and the support, or may be positioned on the back side of the support opposite to the light sensitive layers.

Photographic elements of the invention preferably comprise an antihalation layer comprising process removable or decolorizable filter dyes located between the light sensitive layers of the element and the element support. Depending upon the layer arrangement and sensitivities of the various layers of the element, various filter dyes may be incorporated in the same antihalation layer, and/or may be incorporated into separate antihalation layers. For example, where the element comprises a support bearing in order separate blue-sensitive, red-sensitive, and green-sensitive silver halide layers coated thereon (which is a preferred arrangement for motion picture color print films), a yellow-colored, blue-light absorbing antihalation layer may be coated between the support and the blue-sensitive layer, and a red-light absorbing filter dye containing layer may be coated between the blue-sensitive layer and the red-sensitive layer. In preferred embodiments of the invention, however, all antihalation filter dyes are incorporated in an antihalation layer coated between the support and all silver halide emulsion layers thereon.

Antihalation filter dyes are preferably incorporated into the photographic element in the form of solid particle dispersions which are readily solublized and removed or decolorized upon photographic processing. Preferred filter dyes include those which are substantially insoluble in aqueous coating compositions at pH's of less than 7, and readily soluble or decolorizable in aqueous photographic processing solutions at pH of 8 or above, so as to be removed from or decolorized in a photographic element upon photographic processing. By substantially insoluble is meant dyes having a solubility of less than 1% by weight, preferably less than 0.1% by weight. Such dyes are generally of the formula:

$$D\text{-}(X)_n$$

where D represents a residue of a substantially insoluble compound having a chromophoric group, X represents a group having an ionizable proton bonded to D either directly or through a bivalent bonding group, and n is 1–7. The residue of a compound having a chromophoric group may be selected from conventional dye classes, including, e.g., oxonol dyes, merocyanine dyes, cyanine dyes, arylidene dyes, azomethine dyes, triphenylmethane dyes, azo dyes, and anthraquinone dyes. The group having an ionizable proton preferably has a pKa (acid dissociation constant) value measured in a mixed solvent of water and ethanol at 1:1 volume ratio within the range of 4 to 11, and may be, e.g., a carboxyl group, a sulfonamido group, a sulfamoyl group, a sulfonylcarbamoyl group, a carbonylsulfamoyl group, a hydroxy group, and the enol group of a oxanol dye or ammonium salts thereof. The filter dye should have a log P hydrophobicity parameter of from 0–6 in its non-ionized state. Such general class of ionizable filter dyes is well known in the photographic art, and includes, e.g., dyes disclosed for use in the form of aqueous solid particle dye dispersions as described in International Patent Publication WO 88/04794, European patent applications EP 594 973; EP 549 089; EP 546 163; and EP 430 180; U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179; and 5,266,454; the disclosures of each of which are herein incorporated by reference. Such dyes are generally described as being insoluble in aqueous solutions at pH below 7, and readily soluble or decolorizable in aqueous photographic processing solutions at pH 8 or above.

Preferred dyes of the above formula include those of formula:

$$[D\text{-}(A)_y]\text{-}X_n$$

where D, X and n are as defined above, and A is an aromatic ring bonded directly or indirectly to D, y is 0 to 4, and X is bonded either on A or an aromatic ring portion of D.

Exemplary dyes of the above formulas include those in Tables I to X of WO 88/04794, formulas (I) to (VII) of EP 0 456 163 A2, formula (II) of EP 0 594 973, and Tables I to XVI of U.S. Pat. No. 4,940,654 incorporated by reference above.

It is especially preferable to include a yellow-colored, blue-light absorbing filter dye in an antihalation layer in combination with use of a red light absorbing filter dye such as the barbituric acid oxonol filter dyes as disclosed in commonly assigned, concurrently filed U.S. patent application Ser. No. 08/572,904, filed Dec. 22, 1995, the disclosure of which is incorporated by reference. Exemplary blue-light absorbing dyes and additional red light absorbing dyes include the merostyryl dyes of formula (I), monomethine oxonol dyes of formula (II), and barbituric acid dyes of formula (III) of U.S. Pat. No. 4,770,984, the disclosure of which is hereby incorporated by reference. Additional preferred yellow dyes include yellow arylidene dyes of the above referenced solid particle dye patents. It is further preferred to additionally use a tricyanopropene merostyrene filter dye in combination with the barbituric acid oxonol dye as described in the above referenced concurrently filed application for added safelight protection.

In preferred embodiments of the invention, the antihalation layer is a hydrophilic colloid layer. The hydrophilic colloid is preferably gelatin. This may be any gelatin or modified gelatin such as acetylated gelatin, phthatated gelatin, oxidized gelatin, etc. Gelatin may be base-processed, such as lime-processed gelatin, or may be acid-processed, such as acid-processed ossein gelatin. The hydrophilic colloid may be another water-soluble polymer or copolymer including, but not limited to poly(vinyl alcohol), partially hydrolyzed poly(vinylacetate/vinylalcohol), hydroxyethyl cellulose, poly(acrylic acid), poly(1-vinylpyrrotidone), poly(sodium styrene sulfonate), poly(2-acrylamido-2-methane sulfonic acid), polyacrylamide. Copolymers of these polymers with hydrophobic monomers may also be used.

Antihalation layers used in accordance with preferred embodiments of the invention may alternatively comprise metallic silver or non-photosensitive silver salts of the types previously proposed for use in photographic element antihalation and filter layers, such as described, e.g., in U.S. Pat. Nos. 1,905,188; 2,171,911; 2,571,688; 2,921,914; and 5,246,823, the disclosures of which are hereby incorporated by reference. These include, e.g., Carey-Lea yellow colloidal silver (conventionally used in yellow filter layers), Pechmann blue colloidal silver (U.S. Pat. No. 2,921,914), gray silver (see James, The Theory of the Photographic Process, 4th Ed., p.579), and tabular silver grains (U.S. Pat. No. 5,246,823). The use of conventional gray silver antihalation layers is particularly preferred. Conventional gray silver may be formed by precipitation of silver chloride and the addition of a fogging developer to produce filamentary silver similar to the morphology customarily encountered when conventional silver halide films are processed in a black-and-white developer.

As described above, the filter dyes and/or silver used in antihalation layers are preferably designed to be solubilized and removed or decolorized during photographic processing. Conventional processing of photographic print elements include the Kodak ECP-2B Process for motion picture print films, described in Kodak Publication No. H-24, Manual For Processing Eastman Color Films, the disclosure of which is hereby incorporated by reference.

Incorporation of a process removable or decolorizable filter dye or silver containing antihalation layer eliminates the need for other means of antihalation and backside safelight protection. In a preferred embodiment of the invention, the use of a filter dye or silver containing antihalation layer in place of a carbon containing "rem-jet" antihalation layer provides photographic element processing simplification advantages, allowing for the removal of several currently practiced conventional process steps required for rem-jet removal, such as the prebath and wash steps conventionally performed prior to the development step during processing of rem-jet containing films. Removing these steps is a great environmental advantage in the processing of photographic elements which have previously used rem-jet backing layers such as motion picture films, due to the large water and chemical savings. These modifications simplify the processing steps considerably yielding various economic and environmental advantages.

The following examples illustrate the preparation of photographic elements in accordance with this invention.

EXAMPLE 1

A multilayer photographic element was prepared by coating the following layers on a gelatin subbed polyethylene terephthlate support with rem-jet carbon black containing backing layer (control element A):

| Element A |
|---|
| Protective Overcoat Layer: |
| Poly(dimethyl siloxane) 200-CS, 65.9 mg/m$^2$.<br>Poly(methyl methacrylate) beads, 5.3 mg/m$^2$.<br>Gelatin, 976.3 g/m$^2$.<br>Spreading aids. |
| Green Sensitized Layer: |
| AgClBr cubic grain emulsion, 25% Br, 0.15 micron, spectrally sensitized with green dye cpd 1, 0.5273 mmole/Ag mole, supersensitizer cpd 2, 1.1212 mmole/Ag mole, 312.2 mg/m$^2$.<br>AgClBr cubic grain emulsion, 25% Br, 0.15 micron, spectrally sensitized with green dye cpd 1, 0.5273 mmole/Ag mole, supersensitizer cpd 2, 1.1770 mmole/Ag mole, 121.6 mg/m$^2$.<br>AgClBr cubic grain emulsion, 25% Br, 0.24 micron, spectrally sensitized with green dye cpd 1, 0.4785 mmole/Ag mole, supersensitizer cpd 2, 1.3902 mmole/Ag mole, 39.8 mg/m$^2$.<br>Magenta dye forming coupler (M-1), 699.7 mg/m$^2$.<br>Oxidized developer scavenger, cpd 3, 56.5 mg/m$^2$.<br>Soluble green filter dye 1, 40.0 mg/m$^2$.<br>Soluble green filter dye 2, 58.6 mg/m$^2$.<br>Gelatin, 2077 mg/m$^2$. |
| Interlayer: |
| Oxidized developer scavenger, cpd 3, 79.1 mg/m$^2$.<br>Gelatin, 610.3 mg/m$^2$.<br>Spreading aids. |
| Red Sensitized Layer: |
| AgClBr cubic grain emulsion, 25% Br, 0.15 micron, spectrally sensitized with red dye cpd 4, 0.1808 mmole/Ag mole, supersensitizer cpd 2, 0.6327 mmole/Ag mole, 398.3 mg/m$^2$.<br>AgClBr cubic grain emulsion, 25% Br, 0.24 micron, spectrally sensitized with red dye cpd 4, 0.1356 mmole/Ag mole, supersensitizer cpd 2, 0.7444 mmole/Ag mole, 32.3 mg/m$^2$.<br>Cyan dye forming coupler (C-1), 968.8 mg/m$^2$.<br>Oxidized developer scavenger, cpd 3, 26.0 mg/m$^2$.<br>Soluble red filter dye 3, 120.8 mg/m$^2$.<br>Gelatin, 3453 mg/m$^2$.<br>Gelatin hardener. |
| Interlayer: |
| Oxidized developer scavenger, cpd 3, 79.1 mg/m$^2$.<br>Gelatin, 610.3 mg/m$^2$.<br>Spreading aids. |
| Blue Sensitized Layer: |
| AgCl cubic grain emulsion, 0.58 micron, spectrally sensitized with blue dye cpd 7, 0.3336 mmole/Ag mole, 671.7 mg/m$^2$.<br>AgCl cubic grain emulsion, 0.76 micron, spectrally sensitized with blue dye cpd 7, 0.2669 mmole/Ag mole, 223.9 mg/m$^2$.<br>Yellow dye forming coupler (Y-1), 1883.7 mg/m$^2$.<br>Yellow dye cpd 8, 22.0 mg/m$^2$. |

-continued

| Element A |
| --- |
| Soluble blue filter dye 4, 32.6 mg/m$^2$.<br>Sequestrant cpd 9, 322.9 mg/m$^2$.<br>Sequestrant cpd 10, 35.5 mg/m$^2$.<br>Gelatin, 3980 mg/m$^2$.<br>Support:<br><br>Transparent polyethylene terephthalate support with rem-jet carbon black pigmented, nongelatin layer on the back of the film base which provides antihalation and antistatic properties |

A second multilayer element (Element B) was prepared similarly to Element A, except the rem-jet backed support was replaced with a support having a vanadium pentoxide containing antistatic backing layer and a dye-containing antihalation layer. More specifically, the above described overcoat layer, interlayers, and green, red, and blue sensitized layers were coated over an antihalation layer on a 4.0 micron polyethylene terephthalate base subbed on both sides with a terpolymer latex of methyl acrylate, vinylidene chloride and iraconic acid, which was coated on the backside with an antistatic layer comprising vanadium pentoxide silver-doped at 8%, a terpolymer latex of acrylonitrile, vinylidene chloride, and acrylic acid, and coating aids, and overcoated with a barrier layer of Witcobond™ W232 polyurethane, Neocryl™ CX-100 crosslinker, (poly)methyl methacrylate beads, and coating aids. An ultraviolet absorber compound, cpd 11, was also added to the blue-sensitized layer to provide additional protection from static discharge.

The antihalation layer was prepared using a coating melt prepared as follows. A solid particle dispersion of barbituric acid oxonol cyan filter dye cpd 12 was preparedly circulating a slurry containing 1750 g of dye cpd 12, 416.7 g of a 21% aqueous solution of Triton™ X-200 surfactant, 70.0 g of polyvinylpyrrolidone (Luviskol™ K30), and 8057 g of distilled water through a Netzsch™ LME-2 media mill filled with 2175 ml of zirconia-silicate ceramic beads until the final dispersion particle size was less than 0.4 micron. After milling, the dispersion was diluted with distilled water to a concentration of 10.39% dye. A 15% solid particle dispersion of yellow filter dye cpd 13 was made in a similar manner by milling with Igepon™ T-77 (7% by weight of dye) (Rhone-Poulanc). The two dye dispersions were then mixed with deionized gelatin, polystyrene sulfonic acid sodium salt (a thickener), water, and spreading aids. The structure of Element B is shown below:

| Element B |
| --- |
| Protective Overcoat Layer: Same as Element A<br>Green Sensitized Layer: Same as Element A<br>Interlayer: Same as Element A<br>Red Sensitized Layer: Same as Element A<br>Interlayer: Same as Element A<br>Blue Sensitized Layer:<br><br>Same as Element A, plus Ultraviolet absorber cpd 11, 322.9 mg/m$^2$.<br>Antihalation Layer:<br><br>Cyan dye cpd 12, 16.1 mg/m$^2$.<br>Yellow dye cpd 13, 32.3 mg/$^2$.<br>Polystyrene sulfonic acid sodium salt, 12.9 mg/m$^2$.<br>Deionized gelatin, 758.9 mg/m$^2$.<br>Spreading aids. |

-continued

| Element B |
| --- |
| Support:<br><br>4.0 micron polyethylene terephthalate base subbed on both sides with a terpolymer latex of methyl acrylate, vinylidene chloride and itaconic acid, coated on the backside with an antistat layer comprising 4.3 mg/m$^2$ vanadium pentoxide silver-doped at 8%, 4.3 mg/m$^2$ of a terpolymer latex of acrylonitrile, vinylidene chloride, and acrylic acid, and 3.2 mg/m$^2$ of coating aid Triton ™ X100, and overcoated with a barrier layer comprising 1233 mg/m$^2$ of Witcobond ™ W232, 74.0 mg/m$^2$ of Neocryl ™ CX-100 crosslinker, 26.9 mg/m$^2$ of (poly)methyl methacrylate beads, 39.5 mg/m$^2$ of Triton ™ X100, and 1.1 mg/m$^2$ of Michemlube-160 ™. |

A third multilayer element, Element C, was prepared identically to Element B, except 4.3 mg/m$^2$ of Eastman™ AQ29D polyesterionomer was used as a binder in place of the terpolymer latex of acrylonitrile, vinylidene chloride, and acrylic acid in the antistatic layer.

A fourth multilayer element, Element D, was prepared identically to Element B, except the vanadium pentoxide containing antistatic layer was omitted.

Fifth (Element E), sixth (Element F), and seventh (Element G) multilayer elements were prepared identically to Elements B, C, and D, respectively, except palladium compound P-1 was added to the cyan layer at 8.0 mg/m$^2$. Cyan filter dye cpd 14 was also incorporated into the antihalation layer of Elements E, F and G at 150.7 mg/m$^2$ to provide added safelight protection in the range of 560–630 nm. The solid particle dispersion of cyan dye cpd 14 was made similarly as that for cyan dye cpd 12, except Ketjenlube™ 522 (25% by weight of dye) and Dowfax ™ 2A1 (5% by weight of dye) were used as dispersants.

Separate samples of Elements A through G were stored for 4 weeks at −17.8° C. (0° F.)/50% relative humidity and at 48.9° C. (120° F.)/50% relative humidity to simulate extended raw stock keeping conditions. The elements were then exposed for 1/500 second by means of a 2850 K Tungsten light source through a 0–3 neutral density step tablet, a heat-absorbing filter, and a filter designed to represent a motion picture color negative film. After exposure, the elements were processed through Process ECP-2B using an accelerator and persulfate bleach as described in Kodak Publication No. H-24 referenced above, with the exception that those steps specific to sound track development were omitted.

The optical density due to dye formation was then measured on a densitometer using filters in the densitometer appropriate to the intended use of the photographic element. Dye Density was then graphed vs. log(exposure) to form the Red, Green, and Blue D-LogE characteristic curves of the photographic elements. The changes in Red, Green, and Blue minimum density (D-min) values for the elements A-G stored at 48.9° C. (120° F.) relative to the elements stored at −17.8° C. (0° F.) are shown in Table I.

TABLE I

| Element | Vanadium pentoxide present | Palladium compound present | Delta Red D-min | Delta Green D-min | Delta Blue D-min |
|---|---|---|---|---|---|
| A | no | no | .020 | .014 | .025 |
| B | yes | no | .180 | .151 | .115 |
| C | yes | no | .164 | .133 | .099 |
| D | no | no | .018 | .013 | .026 |
| E | yes | yes | .014 | .018 | .023 |
| F | yes | yes | .015 | .020 | .021 |
| G | no | yes | .019 | .011 | .021 |

The above results indicate good keeping properties are obtained where a vanadium pentoxide containing antistatic layer is not present (Elements A, D, and G), while the presence of such antistat can negatively affect the keeping properties (Elements B and C) even under moderate humidity conditions as evidenced by the significantly higher delta D-mins. The significant effect on keeping properties resulting from the use of vanadium pentoxide antistats in a relatively low speed print film was surprising and unexpected. The above results further demonstrate that a palladium compound may be incorporated to prevent such degradation in keeping properties for print photographic elements containing vanadium pentoxide antistats (Elements E and F) in accordance with Applicants' invention.

The following structures represent compounds utilized in the above described photographic elements.

green sensitizing dye cpd 1

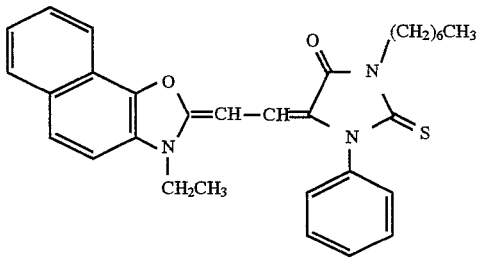

supersensitizer cpd 2

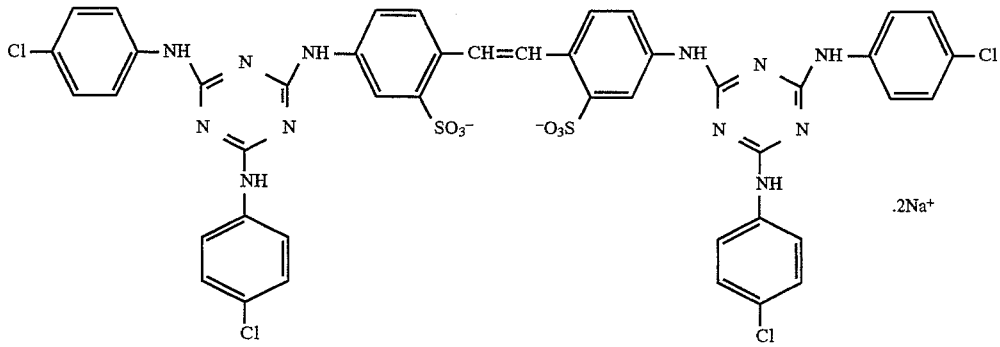

magenta coupler M-1

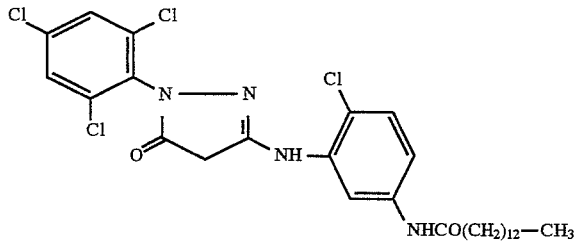

scavenger cpd 3

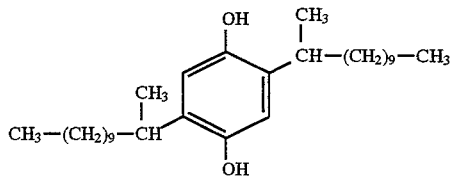

soluble green filter dye #1

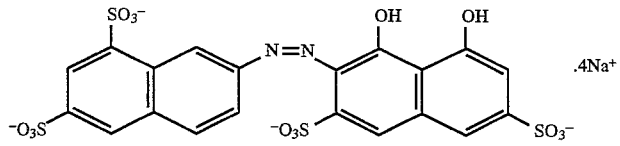

-continued
soluble green filter dye #2
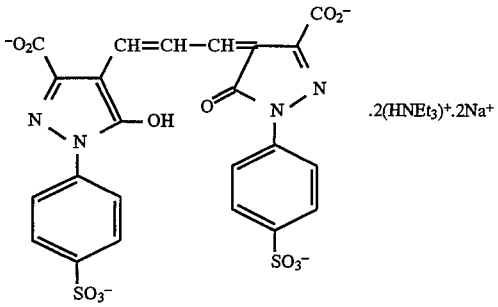
red sensitizing dye cpd 4
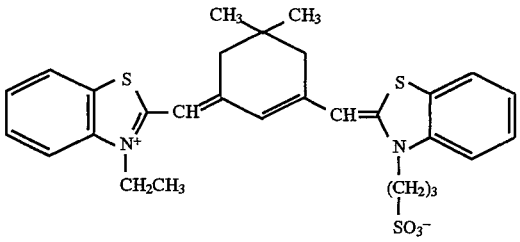
cyan coupler C-1
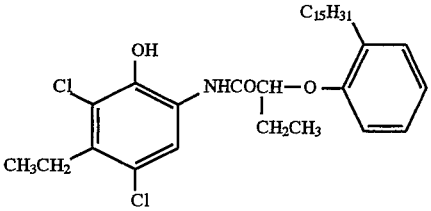
soluble red filter dye #3
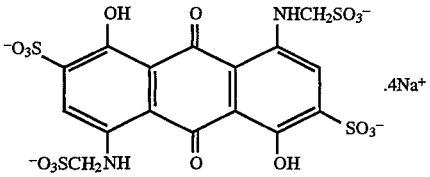
blue sensitizing dye cpd 7
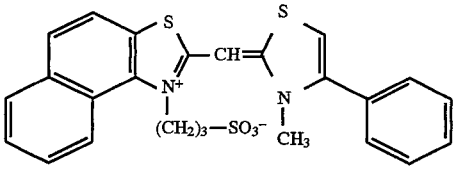
yellow coupler Y-1
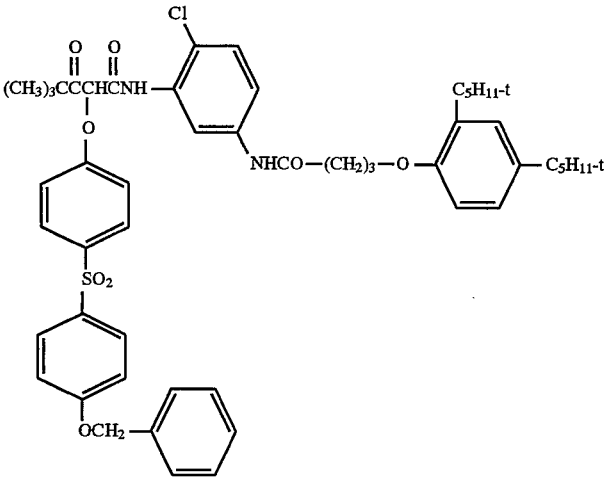

-continued
yellow dye cpd 8
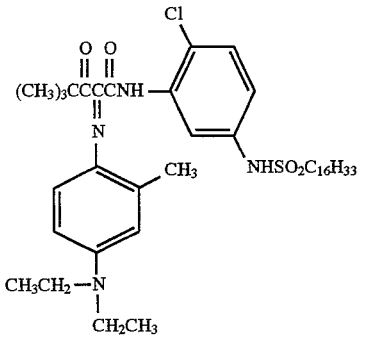
soluble blue filter dye 4
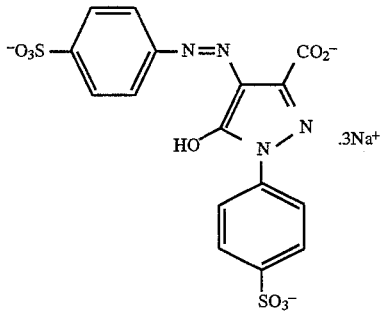
sequestrant cpd 9
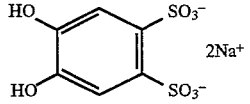
sequestrant cpd 10
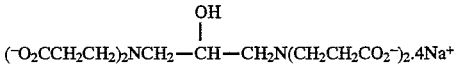
Ultraviolet absorber cpd 11
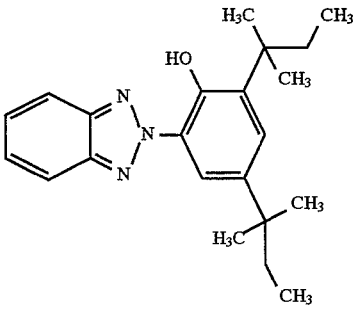
cyan filter dye cpd 12
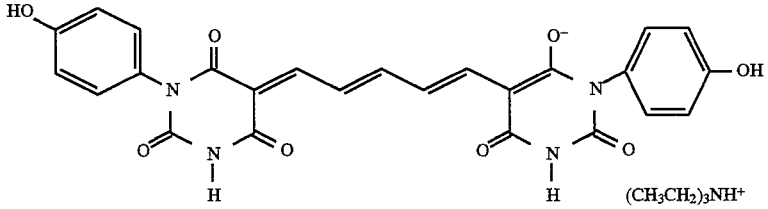
yellow filter dye cpd 13
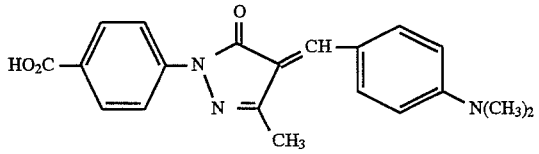

-continued cyan filter dye
cpd 14

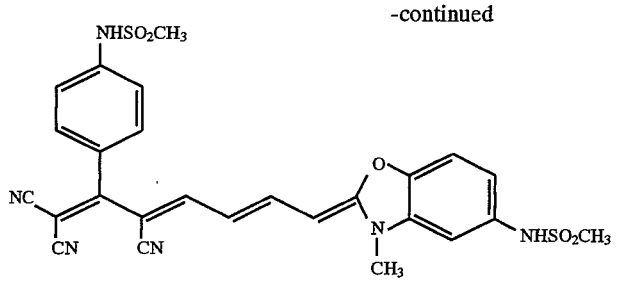

This invention has been described in detail with particular reference to preferred embodiments thereof. It will be understood that variations and modifications can be made within the spirit and scope of the invention.

We claim:

1. A silver halide light sensitive photographic print element having an ISO speed of less than about 10 comprising a support bearing at least one silver halide emulsion image forming layer, an antistatic layer; containing vanadium pentoxide, and a palladium compound wherein the palladium compound is a complex of amines with a palladium(II) ion.

2. The element of claim 1, further comprising an antihalation layer coated between the support and the image forming layer.

3. The element of claim 2, wherein the antihalation layer comprises a hydrophilic colloid layer containing a solid particle dye dispersion.

4. The element of claim 2, wherein the antihalation layer comprises a hydrophilic colloid layer containing metallic silver or substantially non-photosensitive silver salts.

5. The element of claim 1, wherein the antistatic layer is on the opposite side of a support relative to the image forming layer.

6. The element of claim 5, further comprising a protective polymeric overcoat layer coated over the antistatic layer.

7. The element of claim 1, wherein the palladium compound is bis(1,2-ethane diamine-N,N') palladium(II) dichloride.

8. The element of claim 1, wherein the palladium compound is a complex of palladium with glycine.

9. The element of claim 1, wherein the palladium compound is present in the element at from 0.1 to 100 mg/m$^2$ based upon the weight of palladium.

10. The element of claim 1, wherein the palladium compound is present in the element at from 0.1 to 20 mg/m$^2$ based upon the weight of palladium.

11. The element of claim 1, wherein the palladium compound is coated in the image forming layer.

12. The element of claim 1, wherein the palladium compound is coated in a layer of the element other than the image forming layer.

13. The element of claim 1, wherein the silver halide emulsion image forming layer comprises silver bromochloride emulsion grains comprising greater than 50 mole % chloride.

14. The element of claim 13, wherein the emulsion grains have an average equivalent circular diameter of less than 1 micron and an aspect ratio of less than 1.3.

15. A silver halide light sensitive photographic print element having an ISO speed of less than about 10 comprising a support bearing on one side thereof at least one blue-sensitive silver halide emulsion yellow-image forming layer, at least one red-sensitive silver halide emulsion cyan-image forming layer, and at least one green-sensitive silver halide emulsion magenta-image forming layer; an antistatic layer containing vanadium pentoxide; and a palladium compound wherein the palladium compound is a complex of mines with a palladium(II) ion.

16. The element of claim 15, wherein each of the blue-sensitive, red-sensitive, and green-sensitive silver halide emulsion layers comprise silver bromochloride emulsion grains comprising greater than 50 mole % chloride.

17. The element of claim 16, wherein each of the red-sensitive and green-sensitive silver halide emulsion layers comprise emulsion grains having an average equivalent circular diameter of less than 0.60 micron, and the blue-sensitive silver halide emulsion layer comprises emulsion grains having an average equivalent circular diameter of less than 0.90 micron.

* * * * *